United States Patent [19]

Tarumi et al.

[11] 4,411,977

[45] Oct. 25, 1983

[54] TONER IMAGE TRANSFER TO MULTILAYER INTERMEDIATE TRANSFER BODY

[75] Inventors: Noriyoshi Tarumi, Hachioji; Kiyoshi Kimura, Iruma; Tadashi Miwa, Kunitachi, all of Japan

[73] Assignee: Konishiroku Photo Industry Co., Ltd., Tokyo, Japan

[21] Appl. No.: 403,357

[22] Filed: Jul. 30, 1982

[30] Foreign Application Priority Data

Aug. 14, 1981 [JP] Japan ..... 56-126813

[51] Int. Cl.[3] ..... G03G 13/16

[52] U.S. Cl. ..... 430/126; 428/447; 428/412; 428/451; 428/473.5; 428/474.4; 428/475.2; 428/480; 428/502; 428/505; 428/524; 428/914

[58] Field of Search ..... 430/126

[56] References Cited

U.S. PATENT DOCUMENTS

| | | | |
|---|---|---|---|
| 2,637,651 | 5/1953 | Copley | 430/126 X |
| 2,855,324 | 10/1958 | Van Dorn | 430/126 |
| 3,275,436 | 9/1966 | Mayer | 430/126 X |
| 3,535,112 | 10/1970 | Dolce et al. | 430/126 |
| 3,549,360 | 12/1970 | O'Neill et al. | 430/126 |
| 4,370,379 | 1/1983 | Kato et al. | 430/126 X |

OTHER PUBLICATIONS

Davidson et al, "Electrographic Process for Making Transparencies", Res. Discl. 17834.

*Primary Examiner*—Roland E. Martin, Jr.
*Attorney, Agent, or Firm*—Jordan B. Bierman; Linda Bierman; C. Cornell Remsen, Jr.

[57] ABSTRACT

An intermediate transfer body for a transfer type recording apparatus which comprises a substrate consisting of a thermoplastic resin layer and a thermosetting resin layer, wherein said body further comprises an intermediate transfer layer can be added to the intermediate transfer body. The intermediate transfer body consists of an elastic material, such as a fluoro-carbon rubber or a silicone rubber.

7 Claims, 3 Drawing Figures

TONER IMAGE TRANSFER TO MULTILAYER INTERMEDIATE TRANSFER BODY

BACKGROUND OF THE INVENTION

1. Field of the Invention

The present invention relates to an improvement in the intermediate transfer body of a transfer type recording apparatus such as transfer type electrophotographic copying machine.

2. Description of the Prior Art

FIG. 1 shows the intermediate transfer body 1 of a transfer type recording apparatus. Typical conventional intermediate transfer body used hitherto includes a substrate made of a metal such as a stainless steel or a resin, e.g. polyimide, polyester or the like and an intermediate transfer layer made of a material such as fluorocarbon rubber, e.g. TEFLON manufactured by Du Pont, silicone rubber or the like formed on the substrate.

Besides the intermediate transfer body 1 having the form of an endless belt, the copying machine has a drive roller 2 for driving the intermediate transfer body 1, a heat source 3 incorporated in the drive roller 2, a tension roller 4 for imparting a tension to the intermediate transfer body 1, a pressure roller 5 for pressing the surface of the intermediate transfer body 1 against the surface of a photosensitive drum 6 as a toner image retaining member, a charging device 7, a projection device for projecting light 8, a developing device 9, a charge eliminating device 10, a cleaning device 11, a pressure conveyor roller 12 for pressing a recording paper 13 onto the surface of the intermediate transfer body 1 and feed the same in cooperation with the heated drive roller 2, and a conveyor roller 14 for conveying the recording paper 13.

In operation, the photosensitive drum 6 is rotated in the direction of the arrow so that the surface thereof is electrostatically charged uniformly. An electrostatic latent image formed on the charged surface as the light 8 is projected onto the charged surface. The latent image is then developed by the developing device 9. When the developed toner image 15 reaches the position of the pressure roller 5, it is transferred to the surface of the intermediate transfer body 1 and the transferred toner image 15' is further transferred to the recording paper 13 as the same is brought to the position of the pressure conveyor roller 12 as a result of movement of the intermediate transfer body 1 in the direction of the arrow.

The transferred image is then fixed on the recording paper 13 by the heat from the drive roller 2 to become a fixed toner image 15''. In the above case, it is possible to heat the pressure conveyor roller 12 and the drive roller 2 as heating roller.

In this recording apparatus, the following disadvantages (1) to (4) are brought about by the use of the intermediate transfer body 1 having a metallic substrate.

(1) Since the metallic substrate exhibits a high rigidity, the intermediate transfer body 1 exhibits only a small adherence to the photosensitive drum 6 and the recording paper 13. As a result, the efficiency of the transfer of the image, particularly the image transfer from the photosensitive drum 6, is lowered seriously. To obviate this problem, it has been necessary to increase the contact pressure of the pressure roller 5.

(2) Due to the high thermal conductivity of the metallic substrate, the heat is transmitted to other portion than the pressure conveyor roller 12 so that the thermal efficiency of the heat source 3 is lowered and the temperature in the apparatus is raised undesirably.

(3) The fluoro-carbon rubber, silicone rubber or the like material constituting the surface of the intermediate transfer body exhibits only a small strength of bonding to the substrate.

(4) It is difficult to obtain the intermediate transfer body in the form of an endless belt.

It is possible to obtain higher bonding strength by using a high molecule resin such as polyimide, polyester or the like as the material of the substrate of intermediate transfer body 1 than that exhibited when the substrate is made of a metal. However, the thermosetting resin such as polyimide can provide only a small productivity because, in such a case, the intermediate transfer body is formed by a batch type method employing a mould. In addition, the intermediate transfer body made of a thermosetting resin exhibits a small adherence to the photosensitive drum 6 and to the recording paper 13. On the other hand, the intermediate transfer body having a substrate made of a thermoplastic resin such as polyester can be produced at a higher productivity than that having substrate made of a metal or even that having a substrate made of a thermosetting resin. In addition, it is easy to produce an intermediate transfer body in the form of an endless belt and, in addition, a superior adherence to the photosensitive drum 6 and the recording paper 13 is attained. Unfortunately, however, the intermediate transfer body having a substrate made of a thermoplastic resin exhibits inferior physical properties at high temperature in the fixing of the toner image.

SUMMARY OF THE INVENTION

Accordingly, an object of the invention is to provide an intermediate transfer body capable of overcoming the above-described problems of the prior art.

To this end, according to the invention, there is provided an intermediate transfer body comprising a substrate having a thermoplastic resin layer and a thermosetting resin layer.

The above and other objects, features and advantages of the invention will become clear from the following description of the preferred embodiment taken in conjunction with the accompanying drawing.

DESCRIPTION OF THE PREFERRED EMBODIMENTS

Figure 2:
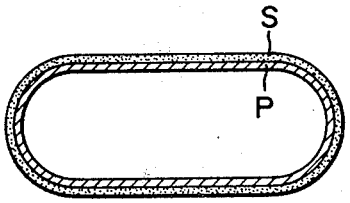
FIG. 2 is a sectional view of an intermediate transfer body in the form of an endless belt, in accordance with an embodiment of the invention.
Figure 3:
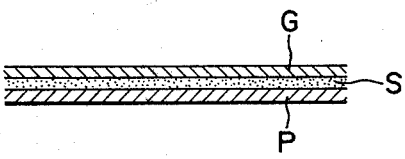
FIG. 3 is a sectional view of an intermediate transfer body in accordance with another embodiment of the invention.

Referring to FIGS. 2 and 3, a symbol P represents a layer of a thermoplastic resin, S represents a layer of a thermosetting resin and G represents an intermediate transfer layer made of a fluoro-carbon rubber, silicone rubber or the like material and constituting a surface layer independent from the resin layers P and S. As shown in FIG. 2, according to the invention, the thermosetting resin layer S constituting the surface of the substrate may be used as the intermediate transfer layer or, alternatively, the thermoplastic resin layer P and the thermosetting resin layer S shown in FIG. 2 may be replaced with each other to permit the use of the thermoplastic resin layer P as the intermediate transfer layer. It is also possible to sandwich the thermoplastic layer P between two thermosetting resin layers S and to use one of the thermosetting resin layers S as the intermediate transfer layer. According to the invention, however, it is preferred to use an intermediate transfer layer G independently of the thermoplastic resin layer P and the thermosetting resin layer S as shown in FIG. 3, because the use of the intermediate transfer layer G independent from the resin layers S and P permits the selection of the kinds of resin layers P and S without taking into account the transfer efficiency. The free selection of the kinds of resins advantageously affords the improvement in the productivity, heat resistance and durability.

The positions of the thermoplastic resin layer P and thermosetting resin layer S may be replaced with each other or the thermoplastic resin layer P may be sandwiched between two thermosetting resin layers S also in the embodiment shown in FIG. 3 as explained in the case of the embodiment shown in FIG. 2. FIG. 3 shows that the intermediate transfer body of the invention can be used not only in the form of an endless belt but also in the form of a planar form.

According to the invention, it is possible to use, as the material of the thermoplastic resin layer P constituting the substrate, various resins such as polyester, polyethylene, polypropylene, polystyrene, polyamide, polyacetal, polycarbonate, polysulfone, polyarylsulfone, polyurea, fluoro-carbon resin and so forth solely or in the form of a blend or copolymer. On the other hand, the thermosetting resin layer S may be formed of a phenol resin, urea resin, melamine resin, xylene resin, diallylphthalate resin, epoxy resin, polyimide, polyimideamide, polydiphenylether, and polybenzimidazole solely or as a compound.

The thermoplastic resin layer is formed as a sheet by a known method in which the material is molten and extracted from a slit, while the thermosetting resin layer is formed by applying the resin liquid onto the surface of the thermoplastic resin and then drying and baking the liquid, thereby to form a sheet consisting of the thermoplastic resin layer P and the thermosetting resin layer S. The intermediate transfer body shown in FIG. 2 is formed by connecting opposite ends of the above-mentioned sheet into the form of an endless belt. The intermediate transfer layer G may be formed by applying an emulsion of fluoro-carbon rubber or silicone rubber on the surface of the thermoplastic resin layer P or the thermosetting resin layer S of the sheet and then drying and baking the emulsion, thereby to form the intermediate transfer body as shown in FIG. 3.

The application of the thermosetting resin liquid and the fluoro-carbon rubber emulsion or the like can be made by any known method such as dipping, spraying, doctor blade method, bar coat method, slide hopper method and so forth.

Figure 1:
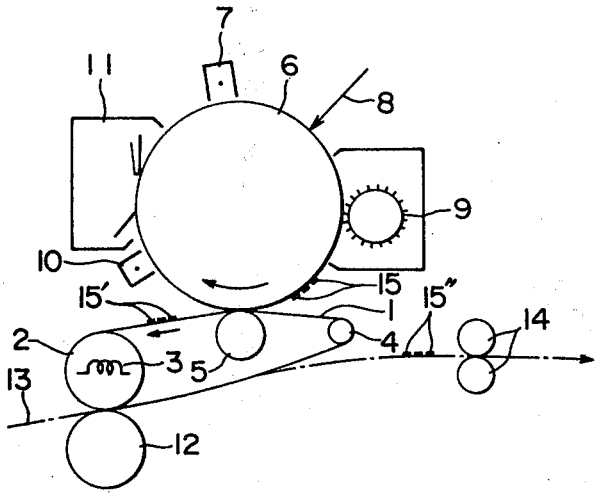
FIG. 1 is an illustration of a transfer type recording apparatus.

The intermediate transfer body of the invention has a construction as explained above. The thermoplastic resin layer P as the substrate improves the productivity of the intermediate transfer body in the form of a sheet or endless belt and, in addition, improves the adherence to the photosensitive drum 6 or the recording paper 13 as shown in FIG. 1. On the other hand, the thermosetting resin layer S improves the heat resistance and durability of the intermediate transfer body. It is thus possible to obtain an intermediate transfer body having superior performance and capable of eliminating the problem inherent in the conventional intermediate transfer body having a substrate made of a metal or the high molecule resin.

The invention will now be fully described hereinunder through specific examples.

EXAMPLE 1

A polyethylene terephthalate sheet of 50μ thick was formed by discharging the material in molten state, drawing and then heat treating the same. An epoxy resin liquid consisting of 75 weight parts of EPIKOTE 828 (produced by Shell Petrochemical Industry) and 25 weight parts of DDM was applied on one surface of the polyethylene terephthalate sheet by means of a doctor blade. The sheet applied with the epoxy resin liquid was subjected to drying and baking conducted for 1 hour at 100° C. and for 5 hours at 125° C., respectively, to form an epoxy resin layer of 25μ thick on the polyethylene terephthalate layer. Meanwhile, a dope was prepared by mixing 100 weight parts of a silicone rubber of self-bonding and addition polymerization type (KE1800 produced by Shinetsu Kagaku K.K., containing suitable amount of filler) and 100 weight parts of toluene, and permitting the mixture to foam sufficiently. The dope was applied to the surface of the epoxy resin layer on the sheet by a doctor blade and, after drying, a baking was conducted for 30 minutes at 150° C. to form a silicone rubber layer of 50μ thick to obtain a laminated sheet having three layers of a total thickness of 150μ. The silicone rubber layer was peeled off over a width of 20 mm along one end of the sheet to reveal the epoxy resin layer to which applied thinly was an adhesive (PRIMER KE41 of Shinetsu Kagaku K.K.). The terephthalate resin layer on the other end of the sheet was then superposed to the epoxy resin layer applied with the adhesive and was left for 24 hours under application of a pressure to obtain an intermediate transfer body in the form of an endless belt.

The intermediate transfer body thus obtained was put into an actual use as the intermediate transfer body 1 shown in FIG. 1 to transfer and fix the toner image on successive 5000 sheets of recording paper 13. Copy images of high contrast and resolution and devoid of any defect were obtained to the final sheet. It was thus confirmed that the intermediate transfer body 1 can carry the toner image in quite a stable manner.

EXAMPLE 2

A U-sheet polyacrylate resin (manufactured by Taihei Chemical Co., Ltd.) was extracted from a circular slit to form an endless belt of 50μ thick. A mixture liquid was prepared by mixing 100 weight parts of a polyimide resin (TORAYNEECE #2000 produced by Toray) and 30 g of solvent of above-mentioned polyimide resin consisting mainly of N-methyl-2 pyrrolidone and containing N,N-dimethylacetamide. The mixture liquid was applied to the belt surface by spraying. The belt was then subjected to a drying conducted for 2 hours at 150° C. and then to a baking conducted for 4 hours at 180° C. to form a polyimide resin layer of 30μ thick to become a laminated sheet having two layers. The surface of the polyimide resin layer of this sheet was beforehand treated with a primer (PRIMER T produced by Shinetsu Kagaku K.K.). A liquid was prepared from 100 weight parts of silicone rubber (KE1300, room temperature vulcanization curing type, produced by Shinetsu Kagaku K.K.), 150 weight parts of toluene and 100 weight parts of kerosene. The liquid was then applied by spraying to the polyimide resin layer surface. The sheet was then subjected to a drying heat treatment conducted for 2 hours at 150° C. to form an intermediate transfer body having an intermediate transfer layer of silicone rubber.

The intermediate transfer body thus produced was put into an actual use as the intermediate transfer body 1 shown in FIG. 1 to make copies on successive 10000 sheets of recording paper 13. Copy images of high contrast and resolution and devoid of any defect were obtained as in the case of Example 1. In consequence, it was confirmed that the intermediate transfer body 1 of this example can carry the toner image in quite a stable manner.

What is claimed is:

1. An image forming process comprising, forming an electrostatic latent image on the surface of an image retaining member, visualizing said electrostatic latent image to a toner image, bringing said toner image into contact with an intermediate transfer body which comprises a substrate consisting of a thermoplastic resin layer and a thermosetting resin layer, and transferring said toner image on the surface of said intermediate transfer body to a recording medium.

2. An image forming process according to claim 1, wherein said body further comprises an intermediate transfer layer.

3. An image forming process according to claim 2, wherein said intermediate transfer layer consists essentially of an elastic material.

4. An image forming process according to claim 3, wherein said elastic material is a fluoro-carbon rubber or a silicone rubber.

5. An image forming process according to claim 1, wherein said body is shaped into formed of an endless belt.

6. An image forming process according to claim 1, wherein said image retaining member is a photosensitive member.

7. An image forming process according to claim 1, wherein said recording medium is a paper.

* * * * *